US009392923B1

(12) United States Patent
Sampaio

(10) Patent No.: US 9,392,923 B1
(45) Date of Patent: Jul. 19, 2016

(54) BIFURCATED DUSTER

(71) Applicant: Casabella Holdings, L.L.C., Congers, NY (US)

(72) Inventor: Andre Sampaio, Valley Cottage, NY (US)

(73) Assignee: CASABELLA HOLDINGS, LLC, Congers, NY (US)

( * ) Notice: Subject to any disclaimer, the term of this patent is extended or adjusted under 35 U.S.C. 154(b) by 0 days.

(21) Appl. No.: 14/858,812

(22) Filed: Sep. 18, 2015

(51) Int. Cl.
*A47L 13/20* (2006.01)
*A47L 13/29* (2006.01)

(52) U.S. Cl.
CPC ..... *A47L 13/29* (2013.01)

(58) Field of Classification Search
CPC ..... A47L 13/29; A47L 13/24; A47L 13/38; A47L 13/46; A47L 13/10
See application file for complete search history.

(56) References Cited

U.S. PATENT DOCUMENTS

| | | | | |
|---|---|---|---|---|
| 177,939 | A * | 5/1876 | Hibbard | A47L 13/38 15/234 |
| 5,592,713 | A * | 1/1997 | Rones | A47K 11/10 15/104.94 |
| 7,328,477 | B1 * | 2/2008 | Aiyar | A46B 11/0017 15/115 |
| 7,886,396 | B2 * | 2/2011 | Gracindo | A46B 7/023 15/144.1 |
| 8,046,865 | B2 * | 11/2011 | Knopow | A46B 5/0075 15/209.1 |
| 8,407,847 | B1 * | 4/2013 | Li | A47L 13/256 15/104.94 |

* cited by examiner

*Primary Examiner* — Shay Karls
(74) *Attorney, Agent, or Firm* — Curtis, Mallet-Prevost, Colt & Mosle, LLP

(57) ABSTRACT

A bifurcated duster is disclosed having a T shaped core and an annular split swivel for changing the cleaning angle of the bifurcated duster. The annular split swivel rides on an annular split swivel track that is joined to the T shaped core. A swivel adjuster engages with the annular split swivel to adjust and set the cleaning angle of the bifurcated duster. Duster covers with elongated bodies are configured to be retained on the T shaped core.

20 Claims, 11 Drawing Sheets

BIFURCATED DUSTER

BACKGROUND OF THE INVENTION

1. Field of the Invention

This invention relates generally to cleaning devices, and more specifically to a bifurcated duster having an adjustable cleaning angle.

2. Description of Related Art

The need to clean surfaces of dust, debris, and other unwanted material has been prevalent in society for thousands of years. Brooms, brushes, dusters, and various other cleaning implements have been applied to the task of cleaning away unwanted materials for thousands of years, and these implements continue to evolve with the use of modern materials and design techniques.

The feather duster, for example, came about as a use for turkey feathers rendered from turkey processing. In 1874 Susan Hibbard filed a patent application for an Improvement in Feather Dusters where she described cutting away the stem of a feather to make the feather more suitable for a feather duster due to its increased flexibility. In 1876, U.S. Pat. No. 177,939 was issued to Susan Hibbard. Modern materials have limited the usefulness of natural materials such as turkey feathers, but with the complexity of modern day life and related modern day conveniences, buildings and other man-made environments, the need for cleaning devices has also never been greater. Traditional dusters, for example, while well suited for removing dust from planar surfaces such as tables, floors, and the like, often fail to provide the necessary geometry and features necessary to clean many of today's modern building attributes such as moldings and trim, baseboards, furniture, light fixtures, skylight openings, angled ceilings, and the like.

What is therefore needed is a duster that has a T shaped core with a first duster cover and a second duster cover that can be angled to facilitate cleaning of the various structures encountered in today's modern homes and buildings.

It is thus an object of the present invention to provide a bifurcated duster that has a first duster cover and a second duster cover. It is another object of the present invention to provide a bifurcated duster that has a T shaped core for retaining the duster covers. It is yet another object of the present invention to provide a bifurcated duster where the cleaning angle can be adjusted.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a bifurcated duster comprising a T shaped core; an annular split swivel track joined to the T shaped core; an annular split swivel rotationally engaged with the annular split swivel track; a swivel adjuster operatively connected with the annular split swivel; a retainer sleeve joined to the annular split swivel for receiving and retaining a pole; and a first duster cover and a second duster cover adapted to be received by the T shaped core.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
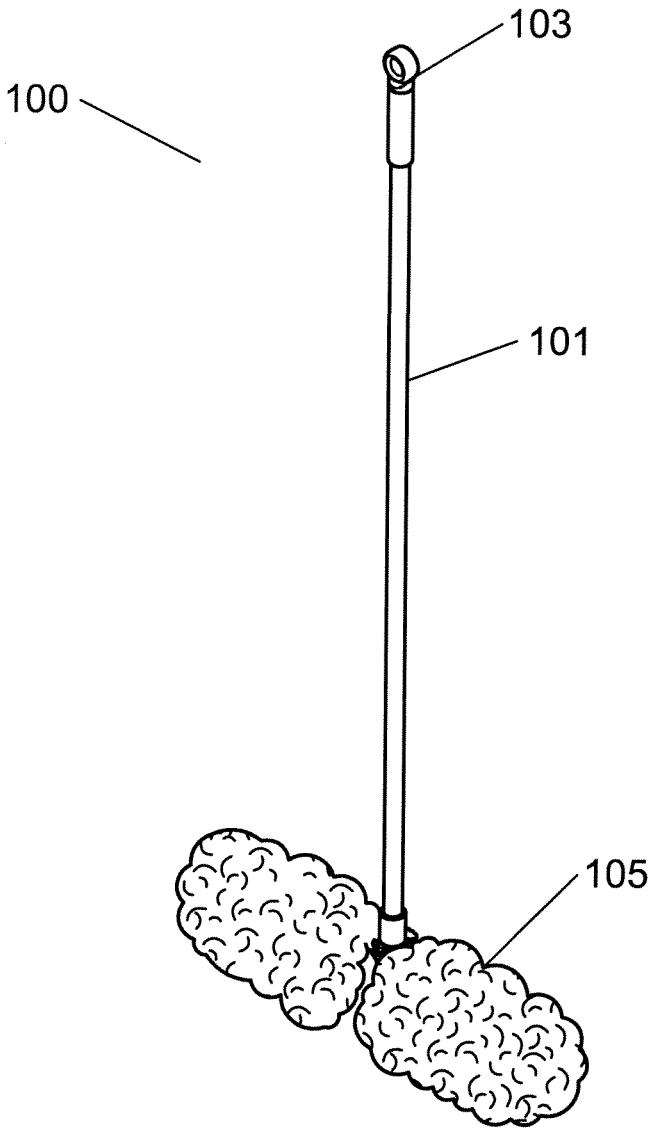
FIG. 1 is a perspective view of a bifurcated duster of the present invention.

The attached figures depict various views of the bifurcated duster in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A bifurcated duster is described and depicted by way of this specification and the attached drawings.

For a general understanding of the present invention, reference is made to the drawings. In the drawings, like reference numerals have been used throughout to designate identical elements.

The bifurcated duster of the present invention, as described and depicted herein, provides, among other things, a novel multi-part bifurcated duster head where the cleaning angle can be adjusted through a novel swivel mechanism.

FIG. 1 is a perspective view of the bifurcated duster 100 according to one embodiment of the present invention. The bifurcated duster components may be made from any suitable rigid or semi-rigid material, for example, a plastic. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, wood, or other materials that may be suitably formed may also be used. The various components of the bifurcated duster may be made by injection molding, blow molding, machining, extruding, forming, or the like. The various components are then assembled in accordance with the instructions and figures provided herein.

A bifurcated duster 101 can be seen comprising a bifurcated duster head 105 having a first section and a second section. A pole 101 having an end 103 can be seen attached to the bifurcated duster head 105. The pole may be made from a metal such as steel or aluminum, or may, alternatively, be made from a wood or a plastic. The end 103 may be an end cap, covering, or simply the end of the pole 101, or may, in some embodiments of the present invention, be a swivel mechanism, a ring, a storage feature, or the like. Shown in FIG. 1 are duster covers retained at each section of the bifurcated duster head.

Figure 2:
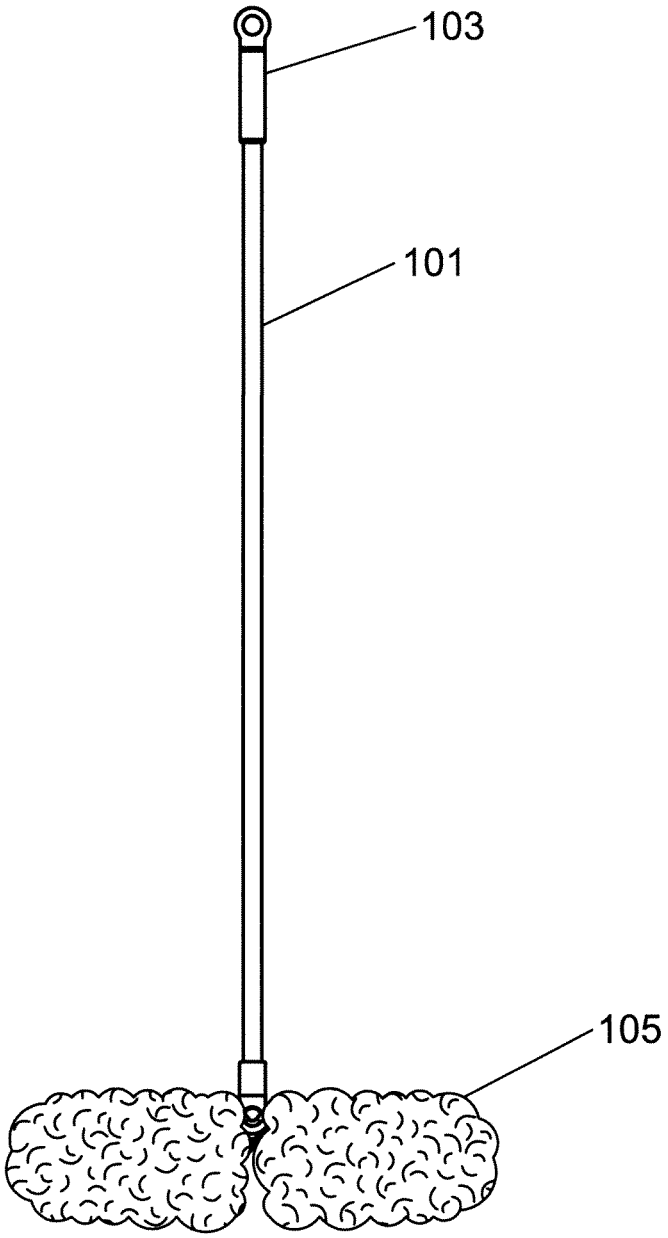
FIG. 2 is a plan view of the bifurcated duster.

Turning now to FIG. 2, a plan view of the bifurcated duster is depicted. The duster covers are being retained on the duster core with straps that traverse a strap cleat that is formed with or a part of the duster core, as will be further depicted in subsequent figures.

Figure 3:
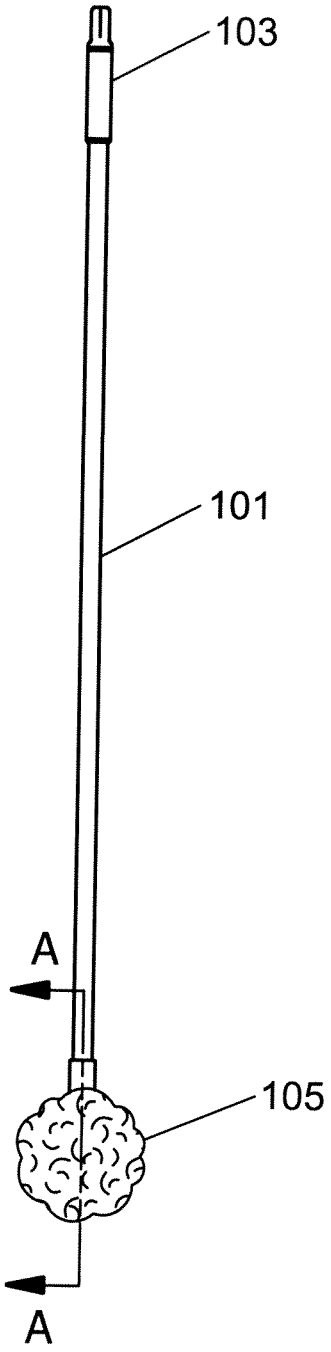
FIG. 3 is a side plan view of the bifurcated duster.

FIG. 3 is a side plan view of the bifurcated duster that shows the elongated cylindrical form of each section of the bifurcated duster 101.

Figure 4:
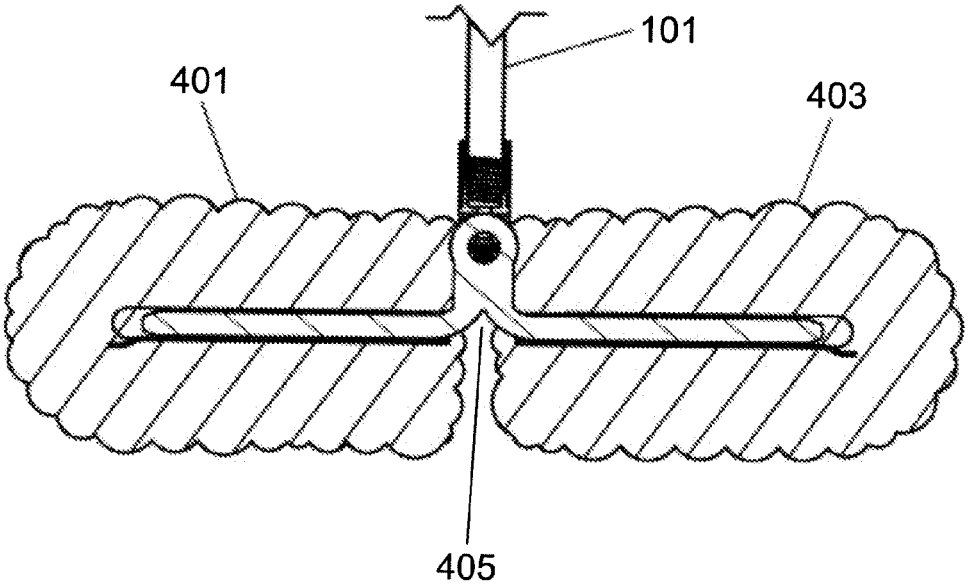
FIG. 4 is a cutaway view of the bifurcated duster taken along line A-A of FIG. 3.

To clearly show the novel mechanism of the bifurcated duster of the present invention, FIG. 4 is a cutaway view of the bifurcated duster taken along line A-A of FIG. 3. A first duster cover 401 and a second duster cover 403 can be seen retained and supported by the duster core that may be a T shaped core 405 or have a similar geometry to provide the necessary shape and support for the bifurcated duster. The core 405 may be made from a plastic, and may be molded with other features such as an annular split swivel track, a strap cleat, and other features that will be further described herein.

The duster covers may be made from a natural or synthetic fiber, for example, a polypropylene or polyester yarn or fiber.

In some embodiments of the present invention, the duster covers comprise cleaning fibers such as microfiber or other synthetic fibers that are suitable for cleaning purposes. In some embodiments of the present invention, the cleaning fibers have triboelectric properties to facilitate the retention of dust and debris onto the duster covers.

Figure 5:
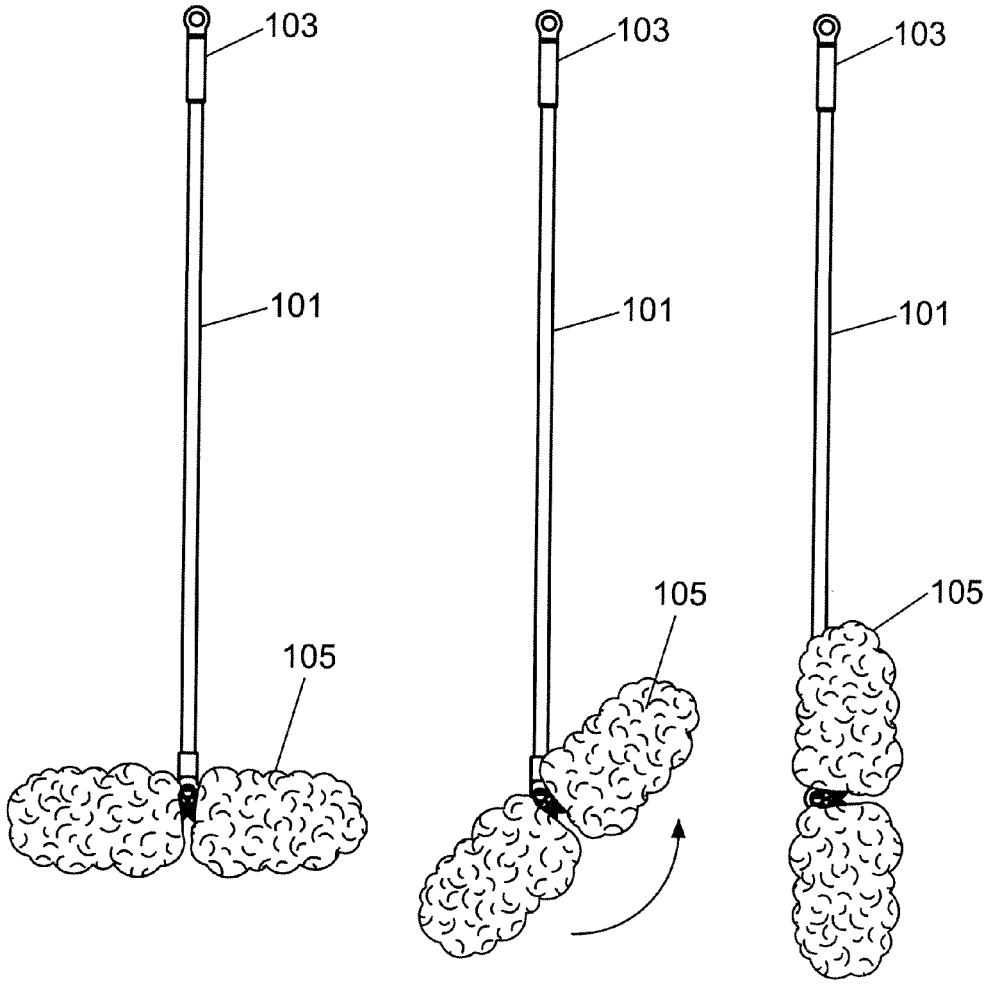
FIG. 5 depicts the bifurcated duster changing cleaning angle.

FIG. 5 depicts the bifurcated duster in use changing the cleaning angle of the duster head. The bifurcated duster can be used to remove dust or other debris by moving the duster head and related duster covers across the surface or object to be cleaned. Once the duster covers are full of dust and small debris, they can be shaken out in a suitable location, and may also, as necessary, be removed from the duster head and washed prior to further use. Changing the cleaning angle of the bifurcated duster allows one to clean complex or irregular shaped objects and building features. To change the cleaning angle, a novel swivel adjuster and split swivel arrangement is employed. A plurality of angle settings can be established with this mechanism by way of a simple push of a swivel adjuster on either end.

Figure 6:
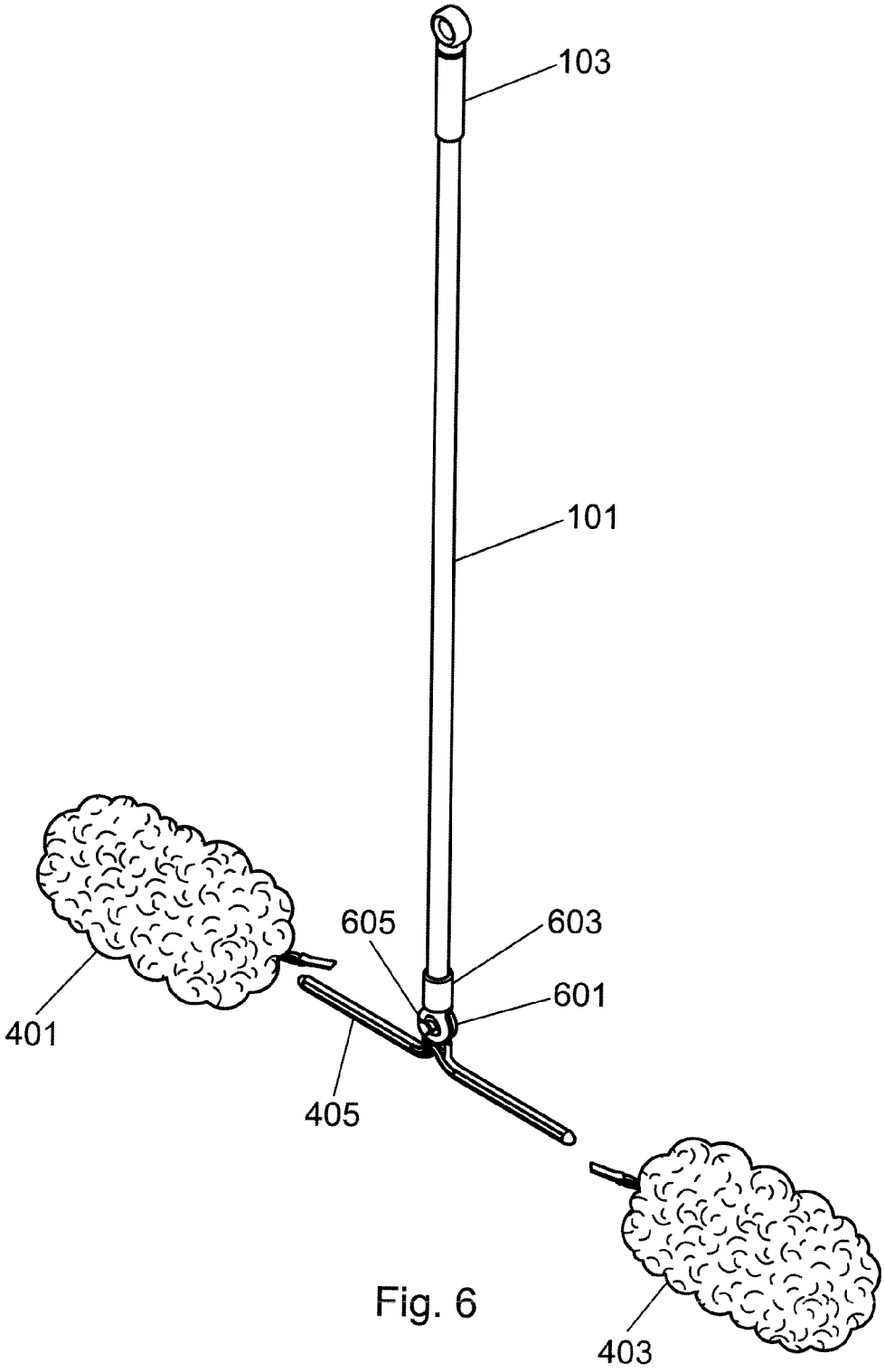
FIG. 6 is an exploded perspective view of the bifurcated duster.

FIG. 6 is an exploded perspective view of the bifurcated duster with the duster covers moved away from the duster core 405. The duster covers 401 and 403 are of an elongated generally tubular or cylindrical shape. An elongated inner cavity receives the bifurcated duster core 405 as seen in FIG. 6. An open end and a closed end can also be seen, where the closed end may, in some embodiments of the present invention, be rounded, hemispherical, squared off, fluted, ridged, angled, or the like. The strap cleat 605 may also be seen that retains the duster covers by way of attached elastic or other straps. In some embodiments of the present invention, the dust covers have an elastic strap formed as a loop and may, in some embodiments of the present invention, have a pull strap attached to the elastic strap to facilitate stretching and placement of the elastic strap about the strap cleat 605. An annular split swivel 601 and related collar 603 can also be seen that allow the bifurcated duster to change cleaning angle.

Figure 7:
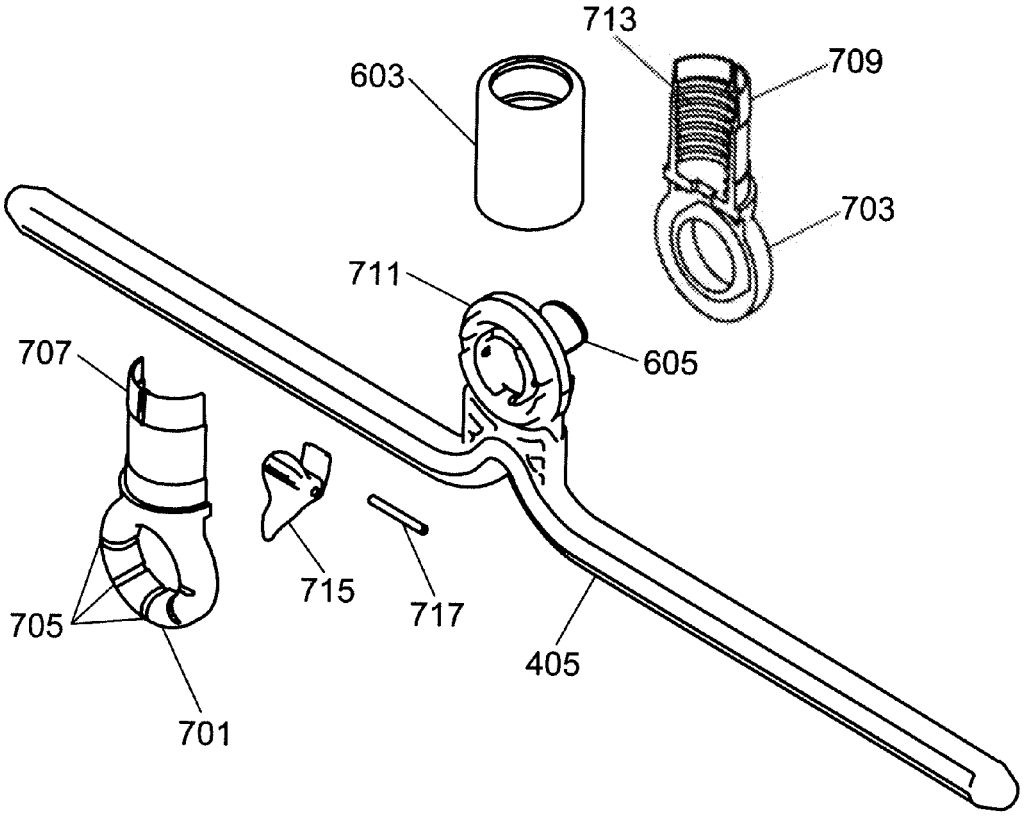
FIG. 7 is an exploded perspective view of the bifurcated duster head without duster covers.

FIG. 7 is an exploded perspective view of the bifurcated duster head without duster covers showing the various components that make up the structure of the bifurcated duster. In particular, the T shaped core 405 has an annular split swivel track 711 joined or otherwise formed to the T shaped core 405. The annular split swivel track 711 has a raised, or in some embodiments, lowered or recessed, track that can be seen in FIG. 7. An annular split swivel 601 (see FIG. 6) may, in some embodiments of the present invention, comprise a first half 701 and a second half 703 that are joined or attached together to permit travel and rotation about the annular split swivel track 711. In some embodiments of the present invention, the first half 701 has a series of notches, recesses, indents, or even raised features such as notches 705. These features interact with swivel adjuster 715 to provide positive adjustment and retention of a selected cleaning angle. A retainer sleeve first half 707 is further joined to the first half 701 and a similar retainer sleeve second half 709 is joined to the second half 703. The retainer sleeves may contain internal threads 713 or other retention features that serve to engage and positively retain a pole such as the pole 101 depicted in FIG. 1. The retainer sleeves may also contain cuts or other features that allow compression of the two retainer sleeves with a structure such as the collar 603. It should also be noted that a strap cleat 605, as previously described, is joined or otherwise formed with the T shaped core 405. The strap cleat 605 may take on a variety of forms, including a heart shape, an oval shape, a round shape, an elongated shape, or the like. The strap cleat 605 may contain a stem or other such feature to raise the retention form away from the main core body, thus facilitating placement and retention of straps or bands from the duster covers. Placed within the opening of the annular split swivel track 711 and related annular split swivel 601 (halves 701 and 703 forming the annular split swivel 601 of FIG. 6) is a swivel adjuster 715. The swivel adjuster 715 forms a point or similar structure that also has an engaging feature that interacts with the notches 705 to provide positive selection and retention of a given cleaning angle. The swivel adjuster 715 also has an opposing end that, when depressed, pulls the engaging feature from the notch in the annular split swivel due to the curved shape of the swivel adjuster where both the point and the opposing end of the swivel adjuster are raised. The swivel adjuster 715 also has a hinge arrangement such as holes to receive a pin 717. The pin 717 may be a metal, plastic, or the like, and may, in some embodiments of the present invention, have at least one tapered end for ease of assembly. The pin 717 that travels through the holes in the swivel adjuster 715 is in turn held in place by holes in the annular split swivel track, as can be seen in FIG. 7.

Figure 11:
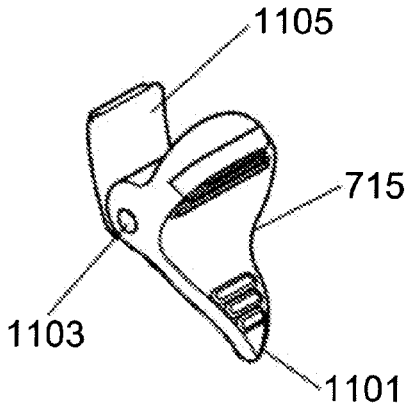
FIG. 11 depicts a perspective view of the swivel adjuster.
Figure 12:
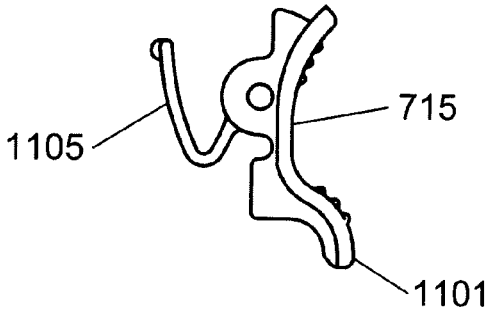
FIG. 12 depicts a side view of the swivel adjuster.

FIG. 11 further provides a close up perspective view of the swivel adjuster 715 where the hinge 1103 can be seen along with the spring hinge 1105 that provides a return force when the swivel adjuster 715 is pushed on either end in order to change the cleaning angle of the duster head. FIG. 12 depicts a side view of the swivel adjuster.

Figure 8:
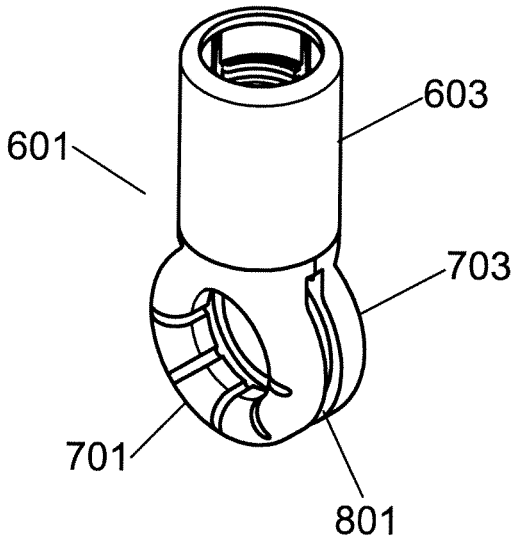
FIG. 8 is a perspective view of the annular split swivel with attached collar.

FIG. 8 is a perspective view of the annular split swivel with attached collar 603. The annular split swivel 601 comprises a first half 701 and a second half 703 assembled about the annular split swivel track 711 (not present in FIG. 8). The annular split swivel track 711 is attached to the T shaped core 405 (also not present in FIG. 8) and the annular split swivel moves along the annular split swivel track 711 in a circular manner, with the T shaped core 405 free to move through the split 801 that can be seen in FIG. 8.

Figure 9:
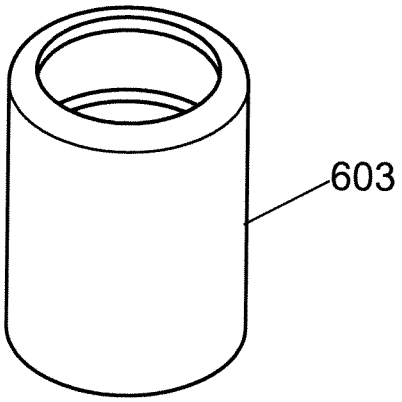
FIG. 9 is a perspective view of the collar of the bifurcated duster head.

The collar 603 that secures the first half 701 and the second half 703 and helps to retain an inserted pole (such as 101 in FIG. 1) can be seen in perspective view in FIG. 9.

Figure 10:
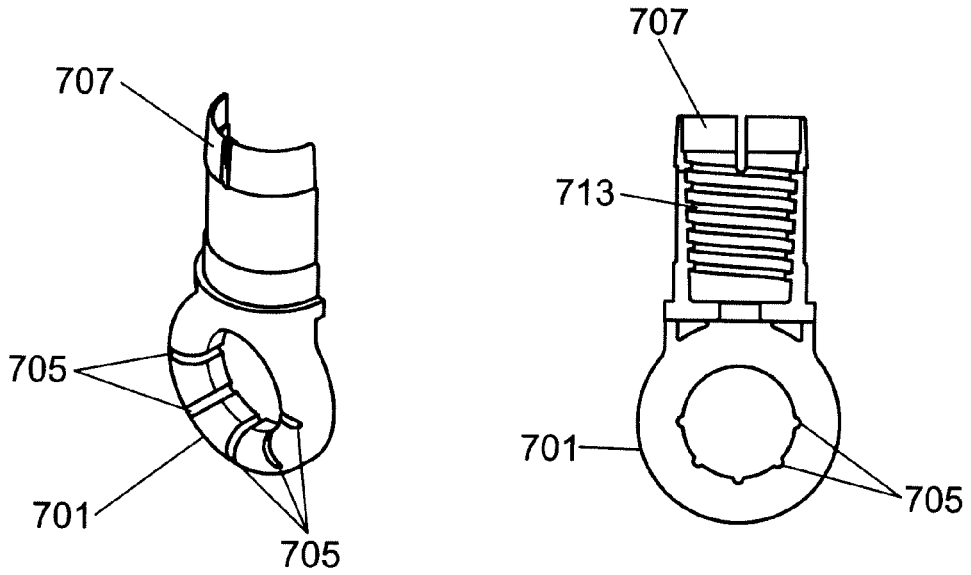
FIG. 10 depicts two views of half of the annular split swivel.

FIG. 10 depicts two views of half of the annular split swivel showing the inner recess that accommodates the annular split swivel track 711. In this view, notches 705 can be seen. The opposing half of the annular split swivel may, in some embodiments of the present invention, not have notches or related features.

Figure 13:
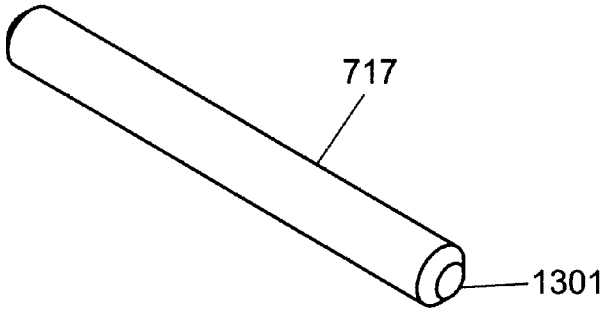
FIG. 13 depicts a perspective view of the pin that hinges the swivel adjuster.

FIG. 13 depicts a perspective view of the pin 717 that hinges the swivel adjuster. In some embodiments of the present invention, a taper 1301 may be present on at least one end of the pin 717.

Figure 14:
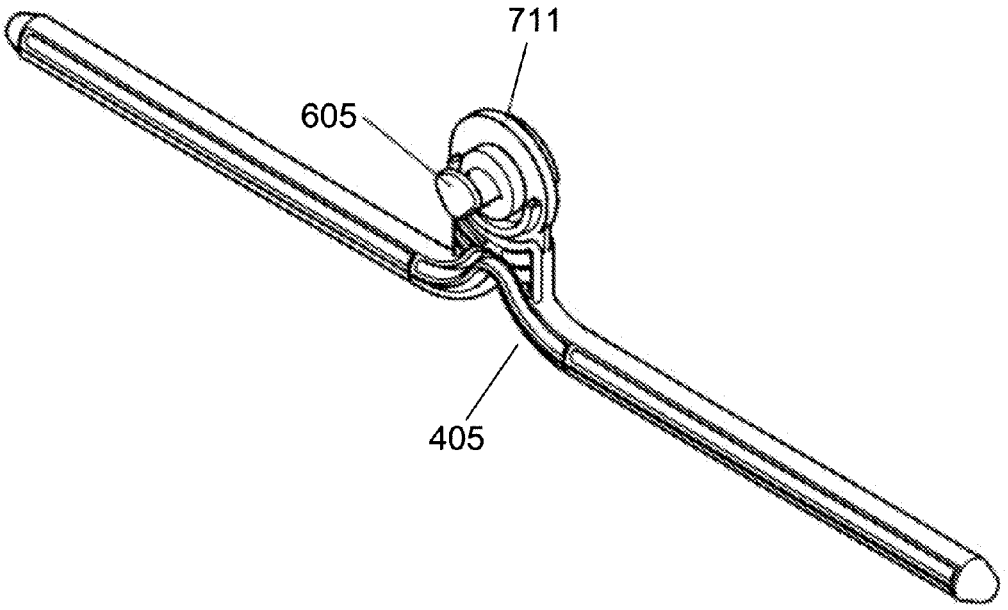
FIG. 14 is a perspective view of the T shaped core.

FIG. 14 is a perspective view of the T shaped core 405. To ease insertion into the duster covers (not shown in FIG. 14), a taper may be present at the end of each arm or section of the core 405. Between the arms and the annular split swivel track 711 a flat joining element can be seen that can pass through the split 801 (see FIG. 8) of the annular split swivel 601 when the duster head is angled through the rotational interaction of the annular split swivel 601 and the annular split swivel track 711.

Figure 15:
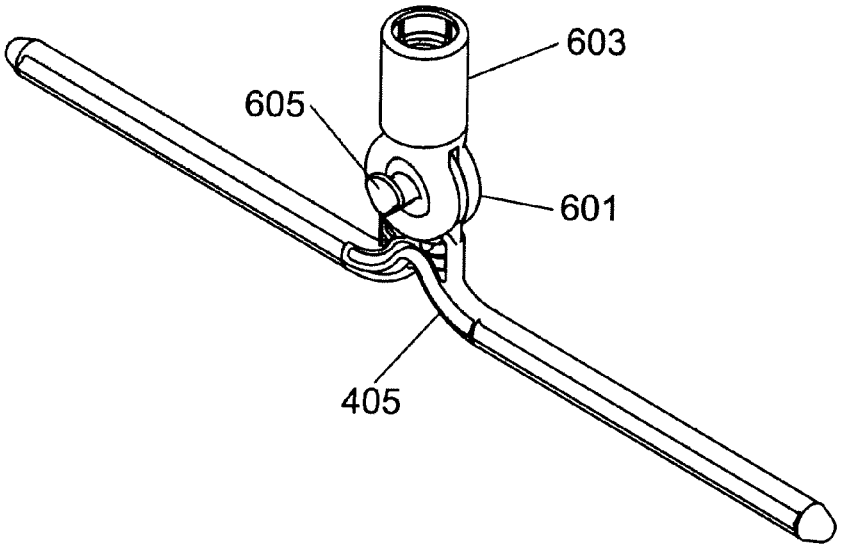
FIG. 15 is a perspective view of the T shaped core with attached annular split swivel and collar showing the strap cleat side.
Figure 16:
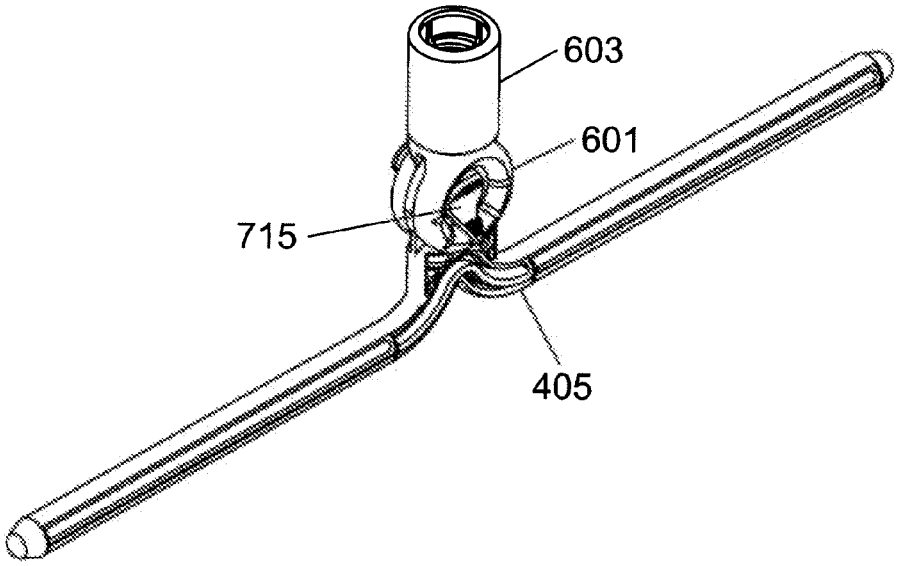
FIG. 16 is a perspective view of the T shaped core with attached annular split swivel and collar showing the swivel adjuster side.

FIG. 15 is a perspective view of the T shaped core 405 with attached annular split swivel 601 and collar 603 showing the strap cleat (605) side. In a similar manner. FIG. 16 is a perspective view of the T shaped core 405 with attached annular split swivel 601 and collar 603 showing the swivel adjuster (715) side.

Use of the bifurcated duster of the present invention has been previously described herein, including use of the novel cleaning angle adjustment apparatus.

It is, therefore, apparent that there has been provided, in accordance with the various objects of the present invention, a bifurcated duster. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A bifurcated duster comprising:

a T shaped core;

an annular split swivel track joined to the T shaped core;

an annular split swivel rotationally and annularly engaged with the annular split swivel track;

a plurality of notches circumferentially arranged about the annular split swivel;

a swivel adjuster having a pointer for engaging with a selected notch on the annular split swivel;

a retainer sleeve joined to the annular split swivel for receiving and retaining a pole; and a first duster cover and a second duster cover adapted to be received by the T shaped core.

2. The bifurcated duster of claim 1, wherein the retainer sleeve further comprises threads for receiving and retaining a pole.

3. The bifurcated duster of claim 1, wherein the swivel adjuster further comprises a hinge.

4. The bifurcated duster of claim 1, wherein the swivel adjuster comprises a spring hinge.

5. The bifurcated duster of claim 1, further comprising a pin for hingably retaining the swivel adjuster to the annular split swivel track.

6. The bifurcated duster of claim 1, wherein the pin has at least one tapered end.

7. The bifurcated duster of claim 1, further comprising a collar fixed about the retainer sleeve.

8. The bifurcated duster of claim 1, wherein the first duster cover and the second duster cover comprise microfibers.

9. The bifurcated duster of claim 1, further comprising a strap cleat joined to the annular split swivel track.

10. The bifurcated duster of claim 1, wherein the annular split swivel comprises a first half and a second half.

11. The bifurcated duster of claim 1, wherein each duster cover has a strap for securing the duster cover on the T shaped core.

12. The bifurcated duster of claim 11, wherein the strap retains the duster cover on the T shaped core with the strap cleat.

13. The bifurcated duster of claim 11, wherein the strap further comprises a pull strap for stretching the strap around the strap cleat.

14. The bifurcated duster of claim 1, further comprising a pole for coupling to the annular split swivel of the bifurcated duster.

15. The bifurcated duster of claim 14, further comprising a swivel end attached to the pole.

16. A duster cover having an elongated tubular shape, an elongated inner cavity for receiving the bifurcated duster core of claim 1, an open end, a closed end, and a strap affixed to the open end.

17. The duster cover of claim 16, wherein the strap has elastic properties.

18. The duster cover of claim 16, further comprising a pull strap connected to the strap.

19. The duster cover of claim 16, wherein the duster cover comprises micro fibers.

20. A bifurcated duster comprising:

a T shaped core;

an annular split swivel track joined to the T shaped core;

an annular split swivel rotationally and annularly engaged with the annular split swivel track;

a swivel adjuster operatively connected with the annular split swivel;

a retainer sleeve joined to the annular split swivel for receiving and retaining a pole; and a first duster cover and a second duster cover adapted to be received by the T shaped core.

* * * * *